US007413524B1

(12) United States Patent
Bibby

(10) Patent No.: US 7,413,524 B1
(45) Date of Patent: Aug. 19, 2008

(54) DRIBBLE TRAINING DEVICE

(76) Inventor: Charlie H. Bibby, 3750 Main St., Philadelphia, PA (US) 19127

( * ) Notice: Subject to any disclaimer, the term of this patent is extended or adjusted under 35 U.S.C. 154(b) by 0 days.

(21) Appl. No.: 11/467,764

(22) Filed: Aug. 28, 2006

(51) Int. Cl.
*A63B 43/00* (2006.01)

(52) U.S. Cl. ..... 473/595; 473/614; 473/596

(58) Field of Classification Search ..... 473/593–595, 473/614, 596, 597; D21/707
See application file for complete search history.

(56) References Cited

U.S. PATENT DOCUMENTS

| | | | | | |
|---|---|---|---|---|---|
| 563,170 | A | * | 6/1896 | Haley et al. | 473/595 |
| 744,718 | A | * | 11/1903 | Cassidy | 473/614 |
| 2,078,382 | A | * | 4/1937 | Hanshaw | 473/595 |
| 2,362,064 | A | * | 11/1944 | Giesinger | 473/595 |
| 2,960,794 | A | * | 11/1960 | Johns | 473/614 |
| 4,738,447 | A | | 4/1988 | Brown | |
| 4,991,838 | A | | 2/1991 | Groves | |
| D317,805 | S | * | 6/1991 | Swan | D21/707 |
| 5,028,053 | A | * | 7/1991 | Leopold | 473/473 |
| D358,858 | S | * | 5/1995 | McGreevy | D21/707 |
| 5,419,552 | A | | 5/1995 | Meyer | |
| 5,500,956 | A | | 3/1996 | Schulkin et al. | |
| 5,577,732 | A | * | 11/1996 | Spector | 473/576 |
| D393,671 | S | * | 4/1998 | Honaker | D21/707 |
| 5,833,233 | A | | 11/1998 | Strug | |
| 6,443,863 | B1 | * | 9/2002 | Dinoffer | 473/595 |
| 6,612,948 | B1 | * | 9/2003 | Miller | 473/596 |
| D485,590 | S | | 1/2004 | Poegel, Jr. | |
| 2002/0077200 | A1 | | 6/2002 | Kreutzer | |
| 2004/0076938 | A1 | | 4/2004 | Publicover | |
| 2006/0063623 | A1 | * | 3/2006 | Zheng | 473/614 |

* cited by examiner

*Primary Examiner*—Steven Wong

(57) ABSTRACT

A dribble training device for facilitating training of a person to dribble a ball includes a ball including an outer wall defining an interior space. The interior space receives pressurized air to inflate the ball. Each of a plurality of protuberances is integrally coupled to the outer wall of the ball and outwardly extends from an exterior surface of the ball. The protuberances influence an angle of rebound of the ball off of the support surface when the ball is dribbled to randomize the angle of rebound each time the ball impacts the support surface.

8 Claims, 2 Drawing Sheets

DRIBBLE TRAINING DEVICE

BACKGROUND OF THE INVENTION

1. Field of the Invention

The present invention relates to basketballs and more particularly pertains to a new basketball for facilitating training of a person to dribble a ball.

2. Description of the Prior Art

The use of basketballs is known in the prior art. The prior art commonly teaches the use of an irregular shaped ball or the use of specially designed gloves to facilitate learning to dribble a ball.

While these devices fulfill their respective, particular objectives and requirements, the need remains for a ball device that has certain improved features that require a person using the device to quickly adjust to different angles of rebound and, in particular, to teach a person to dribble a ball by feel and without eye contact on the ball. This will force the person using the ball device to use their fingers, instead of their palms, and will force the person to keep their fingers extended while dribbling the ball device. The ball device includes protuberances that are in fluid communication with ball device and pressurized to the same pressure as the ball device to cause the ball device to be deflected off of a floor at angles not coincident with the angle at which the ball device strikes the floor.

SUMMARY OF THE INVENTION

The present invention meets the needs presented above by generally comprising a ball including an outer wall defining an interior space. The interior space receives pressurized air to inflate the ball. Each of a plurality of protuberances is integrally coupled to the outer wall of the ball and outwardly extends from an exterior surface of the ball. The protuberances influence an angle of rebound of the ball off of the support surface when the ball is dribbled to randomize the angle of rebound each time the ball impacts the support surface.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
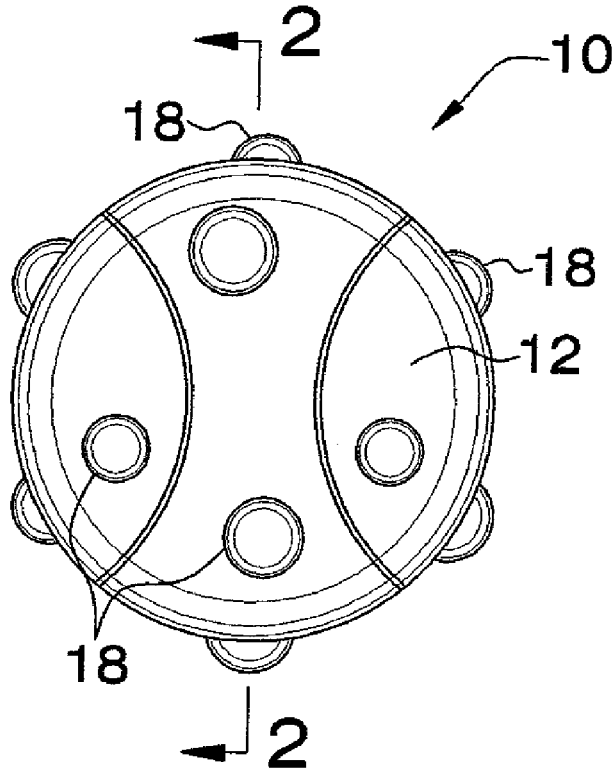
FIG. 1 is a front view of a dribble training device according to the present invention.
Figure 2:
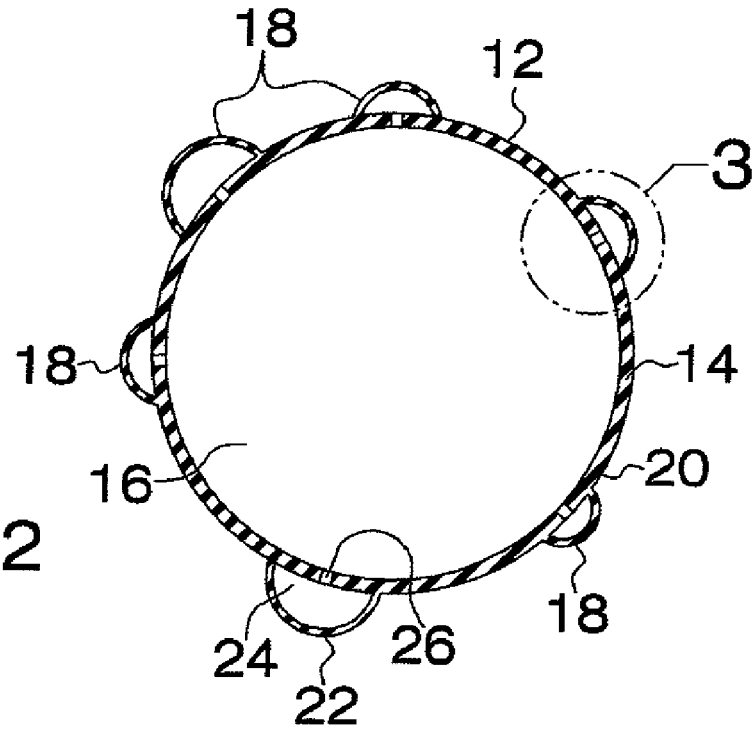
FIG. 2 is a cross-sectional view of the present invention taken along line 2-2 of FIG. 1.
Figure 3:
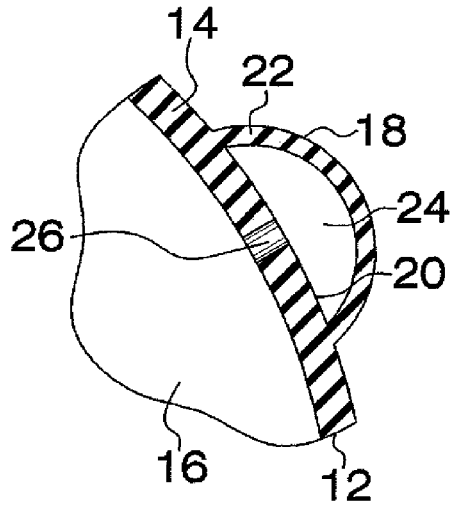
FIG. 3 is an enlarged cross-sectional view of one of the protuberances of the present invention shown in the area designated 3 in FIG. 2.
Figure 4:
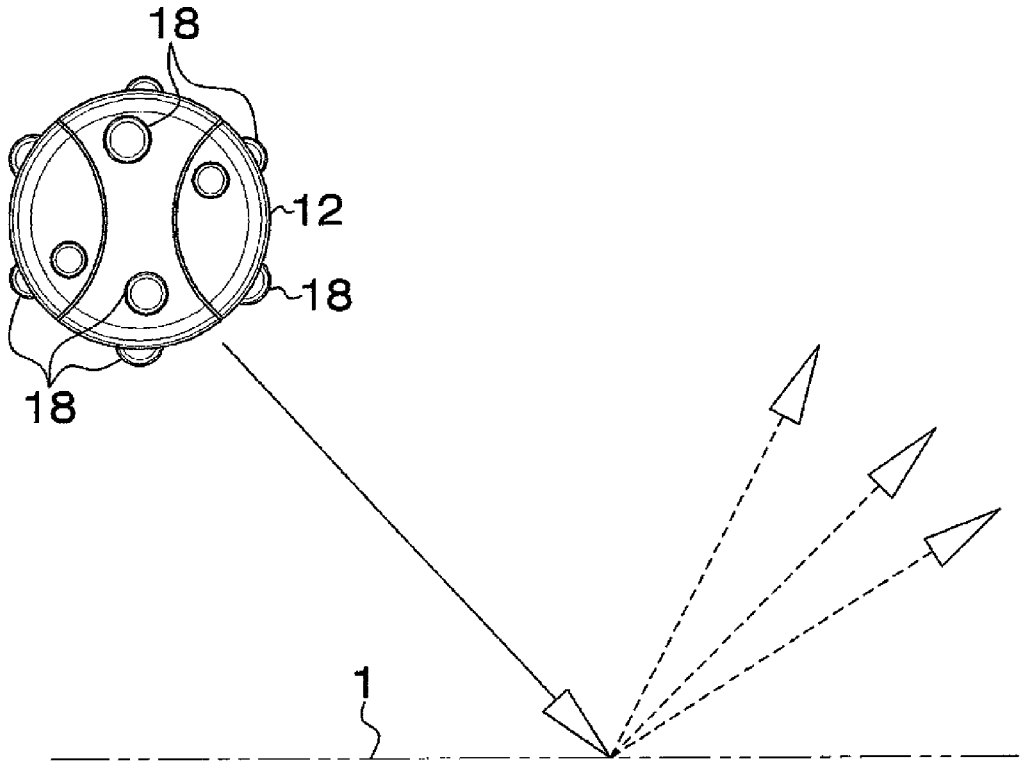
FIG. 4 is a side view of the present invention shown in use.

With reference now to the drawings, and in particular to FIGS. 1 through 4 thereof, a new basketball embodying the principles and concepts of the present invention and generally designated by the reference numeral 10 will be described.

As best illustrated in FIGS. 1 through 4, the dribble training device 10 generally comprises a ball 12 including an outer wall 14 defining an interior space 16 contained within the outer wall 14. The interior space 16 receives pressurized air to inflate the ball 12. The outer wall 14 is comprised of a flexible material to permit the ball 12 to bounce off of a support surface 1 when the ball 12 is dribbled. The flexible material may include such materials as a leather material, a synthetic leather material or an elastomer.

Each of a plurality of protuberances 18 is integrally coupled to the outer wall 14 of the ball 12 and outwardly extends from an exterior surface 20 of the ball 12. The protuberances 18 influence an angle of rebound of the ball 12 off of the support surface 1 when the ball 12 is dribbled to randomize the angle of rebound each time the ball 12 impacts the support surface 1. For greatest variance of angles of rebound the protuberances 18 would be positioned at random location on the ball 12. Further, the protuberances 18 may be provided in varying sizes so that the protuberances at least include first set of protuberances having a different size than a second set of protuberances. Each of the protuberances 18 includes a shell wall 22 defining an air space 24 between the shell wall 22 and a portion of the exterior surface 20 of the ball 12. The air space 24 of each of the protuberances 18 is in fluid communication with one of a plurality of apertures 26 extending through the outer wall 14 of the ball 12 to permit the protuberances 18 to be inflated when the ball 12 is inflated. Each of the protuberances 18 has a substantially hemi-spherical shape.

In use, the ball 12 is dribbled along the support surface 1. As the ball 12 rebounds off the support surface 1 the protuberances 18 cause the ball 12 to rebound off the support surface 1 at unpredictable angles. This unpredictability requires the person dribbling the ball 12 to adjust quickly to recover the ball 12. More particularly, this will require the person to use only their fingertips, spaced outwardly from each other and the palm, to increase the area covered by their hand to ensure interception of the ball 12. During a coaching exercise, the player will be told to look forward and not at the ball 12 as the ball 12 is being dribbled. If the player incorrectly uses their palm while dribbling, the ball 12 will be easily lost when it is deflected at an unpredictable angle. Thus, the device 10 will encourage use of the fingertips while dribbling a conventional basketball.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A dribble training device for training proper use of a hand while dribbling, said device comprising:

a ball including an outer wall defining an interior space, said interior space receiving pressurized air to inflate said ball; and a plurality of protuberances, each of said protuberances being integrally coupled to said outer wall of said ball and outwardly extending from an exterior surface of said ball, said protuberances influencing an angle of rebound of said ball off of the support surface when said ball is dribbled to randomize the angle of rebound each time said ball impacts the support surface, each of said protuberances including a shell wall defining an air space between said shell wall and a portion of said exterior surface of said ball, said air space of each of said protuberances being in fluid communication with one of a plurality of apertures extending through said outer wall of said ball to permit said protuberances to be inflated when said ball is inflated.

2. The device according to claim 1, wherein said outer wall is comprised of a flexible material to permit said ball to bounce off of a support surface when said ball is dribbled.

3. The device according to claim 1, wherein each of said protuberances has a substantially hemi-spherical shape.

4. The device according to claim 3, wherein said protuberances are randomly positioned on said outer wall.

5. The device according to claim 4, wherein each of said protuberances includes a first set of the protuberances having a different size than a second set of the protuberances.

6. The device according to claim 1, wherein said protuberances are randomly positioned on said outer wall.

7. The device according to claim 1, wherein each of said protuberances includes a first set of the protuberances having a different size than a second set of the protuberances.

8. A dribble training device for training proper use of a hand while dribbling, said device comprising:

a ball including an outer wall defining an interior space, said interior space receiving pressurized air to inflate said ball, said outer wall being comprised of a flexible material to permit said ball to bounce off of a support surface when said ball is dribbled;

a plurality of protuberances, each of said protuberances being integrally coupled to said outer wall of said ball and outwardly extending from an exterior surface of said ball, said protuberances influencing an angle of rebound of said ball off of the support surface when said ball is dribbled to randomize the angle of rebound each time said ball impacts the support surface, each of said protuberances including a shell wall defining an air space between said shell wall and a portion of said exterior surface of said ball, said air space of each of said protuberances being in fluid communication with one of a plurality of apertures extending through said outer wall of said ball to permit said protuberances to be inflated when said ball is inflated, each of said protuberances having a substantially hemispherical shape.

* * * * *